United States Patent [19]

Middleton et al.

[11] 4,251,002

[45] Feb. 17, 1981

[54] TAMPERPROOF CONTAINER AND CLOSURE

[76] Inventors: Andrew D. Middleton, 2 Bellevue Heights, Greystones, County Wicklow; Thomas P. Mitchell, Mill Cottage, Newtownmountkennedy, County Wicklow, both of Ireland

[21] Appl. No.: 26,520

[22] Filed: Apr. 3, 1979

[30] Foreign Application Priority Data

Apr. 4, 1978 [IE] Ireland ..... 665/78

[51] Int. Cl.[3] ..... B65D 41/32

[52] U.S. Cl. ..... 215/253; 215/320

[58] Field of Search ..... 215/252, 32, 253, 250, 215/320; 220/266

[56] References Cited

U.S. PATENT DOCUMENTS

| | | | |
|---|---|---|---|
| 3,463,341 | 8/1969 | Fields | 215/252 |
| 3,638,821 | 2/1972 | Guala | 215/253 |
| 3,923,185 | 12/1975 | Choksi et al. | 215/253 |
| 4,156,490 | 5/1979 | Peraboni | 215/252 |

*Primary Examiner*—George T. Hall

*Attorney, Agent, or Firm*—Pollock, Vande Sande & Priddy

[57] ABSTRACT

A tamper proof container and closure assembly comprises a collar connected to the container by a number of straps moulded to and between the container and collar, so that when the collar is snapped into engagement with the container, the collar can be removed only by breaking one or more of the straps, the collar being sealed to form the closure by the application to the collar of a plug which cannot be removed from the collar without distorting the material of the plug and/or the collar.

7 Claims, 5 Drawing Figures

TAMPERPROOF CONTAINER AND CLOSURE

The present invention relates to containers and closures for containers and is particularly concerned with containers provided with tamper proof closures, that is closures which when opened can be seen to have been opened. Containers with tamper proof closures of this kind are commonly used in the supply of pharmaceutical tablets.

An object of the present invention is to provide a novel form of container with a tamper proof closure.

According to the present invention, there is provided a container having a closure which is connected to the container in a manner such that the container cannot be opened without breaking one or more of a number of connectors which join the closure to the container.

In a preferred construction according to the invention, the closure is connected to the container by two or more straps moulded to and between the container and closure, the latter being adapted to be sealed when the container has been charged. According to a further feature of the invention, the closure is in the form of a collar which can be snapped into engagement with the container before or after the container has been charged, the collar being adapted to be sealed by a plug to form the closure.

The invention will hereinafter be described more particularly with reference to the accompanying drawings which illustrate, by way of example only, a preferred embodiment according to the invention.

Figure 1:
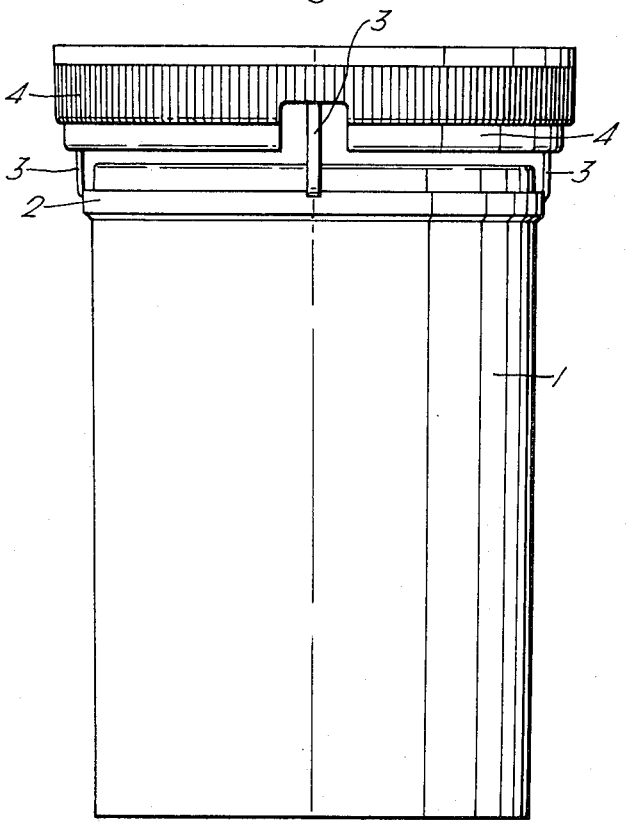
FIG. 1 is an elevational view of the container, showing the collar in the raised position.
Figure 2:
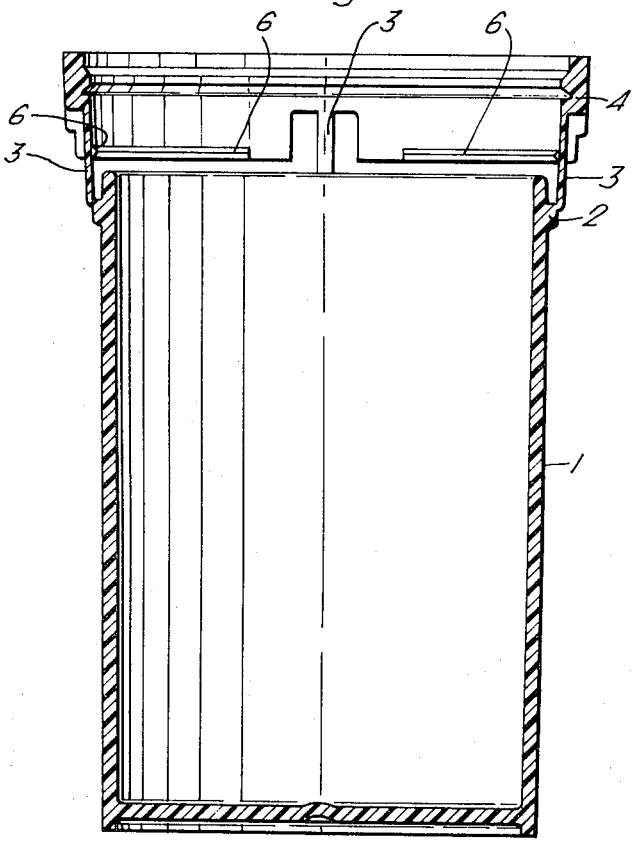
FIG. 2 is a cross-sectional elevation, corresponding to FIG. 1.
Figure 3:
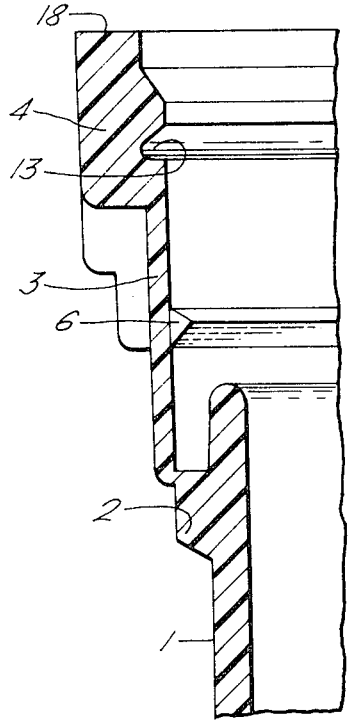
FIG. 3 shows, to an enlarged scale, a detail of FIG. 2 also showing the collar in the raised position.

Referring to the drawings, the container comprises a cylindrical tube 1, open at one end, and closed at the other end. Adjacent the open end and on the exterior of the container 1 is a circumferential band 2. A collar 4, is joined to the band 2 by means of four connectors or straps 3, which are generally located parallel to the axis of the container and collar, the length of the straps being such that when moulded, the collar is resting upon or just above the mouth of the container. As shown in FIGS. 2 and 3, the collar includes a plurality of recesses extending from its edge adjacent the container towards its upper edge; and the straps are connected between the recessed parts of the collar and the circumferential band on the container.

Figure 4:
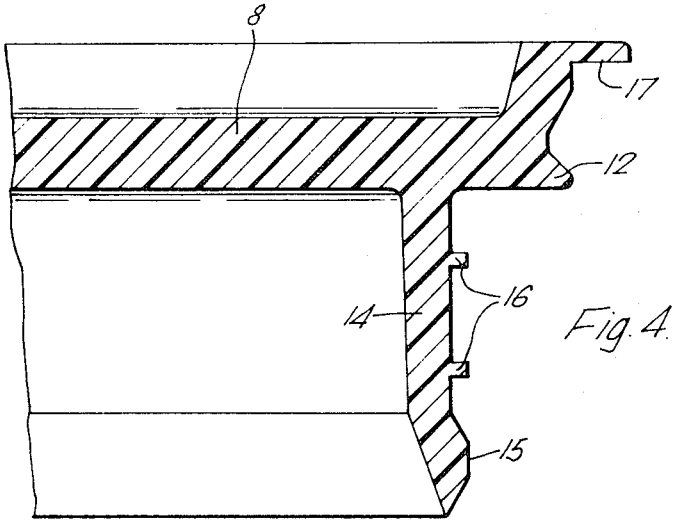
FIG. 4 is a view corresponding to FIG. 3, showing the plug for the closure.

The collar 4 has an inwardly projecting lip 6 which, when the collar is pressed downwardly relative to the container 1, rides over and snaps into engagement with the band 2. The collar 4 also acts as a receiver for a plug in the form of a disc 8 (see FIG. 4) which can be pressed into engagement with the collar when the container has been filled or charged.

The disc 8 has a circumferential projection 12 which snaps into an internal circumferential recess 13 in the collar 4 when the disc 8 has been pressed into engagement with the collar 4.

Figure 5:
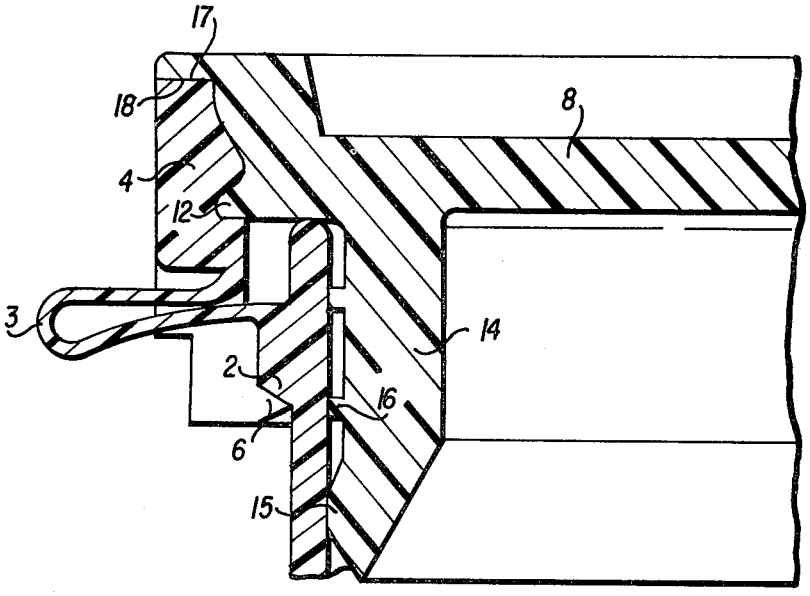
FIG. 5 is a sectional view showing the plug of FIG. 4 inserted into the collar of FIGS. 1 to 3 to form a closure, the closure being snapped into position on the container.

The disc 8 also has a skirt member 14 depending from the disc 8. Extending outwardly from the skirt member 14 is an abutment which provides a circumferential sealing band 15 and sealing rings 16 which serve to prevent the ingress of moisture into the container. See FIG. 5.

Extending upwardly and outwardly from the periphery of the disc 8 is a sealing ring 17 which contacts the upper surface 18 of the collar 4 when the disc 8 has been snapped into engagement with the collar 4 to form the closure. It is thus impossible to remove th disc 8 from the collar 4 without first distorting the material of the sealing ring 17. The container may be opened to provide access to the contents, only by breaking some or all of the straps 3.

It will be appreciated that the container 1, collar 4 and inter-connecting straps 3 may be injection moulded in one operation.

We claim:

1. A tamper proof container and closure assembly comprising a cylindrical container having a closed end and an open end, a collar integrally formed with said container above and adjacent said open end and co-axial with said container, an external circumferential band on said container adjacent said open end, a plurality of flexible straps connecting said collar and container, and inwardly projecting circumferential lip in said collar which is adapted to ride over and to snap into engagement with the circumferential band when the collar is pushed onto said open end of said container, and a plug for said collar, the plug and collar defining a closure which cannot be removed from the container without breaking the straps or distorting the material of the closure.

2. A tamper proof container and closure assembly as claimed in claim 1, in which the collar has a plurality of recesses extending from the edge adjacent the container towards the other edge of the collar, and the flexible straps are connected between the recessed parts of the collar and the circumferential band on the container, the length of the straps being such that when manufactured, the collar is resting upon or just above the open end of the container, and can thereafter be snapped into engagement therewith, the collar not being removable from the container without breaking two or more of the straps.

3. A tamper proof container and closure assembly as claimed in claim 2, in which the plug is a disc which has a circumferential projection which is adapted to snap into an internal circumferential recess in the collar.

4. A tamper proof container and closure assembly as claimed in claim 2, in which the disc has a skirt member depending therefrom and upon which there are protuberances which contact the internal wall of the container, when the container is closed, the protuberances serving to seal the container against ingress of moisture.

5. A container as claimed in claim 4, in which the periphery of the disc has an upwardly and outwardly extending sealing ring which contacts the top of the collar when the disc has been snapped into engagement therewith.

6. A tamper proof container and closure assembly as claimed in claim 3, in which the disc has a skirt member depending therefrom and upon which there are protuberances which contact the internal wall of the container, when the container is closed, the protuberances serving to seal the container against ingress of moisture.

7. A container as claimed in claim 6, in which the periphery of the disc has an upwardly and outwardly extending sealing ring which contacts the top of the collar when the disc has been snapped into engagement therewith.

* * * * *